US008616130B2

(12) United States Patent
Daoud

(10) Patent No.: US 8,616,130 B2
(45) Date of Patent: Dec. 31, 2013

(54) LINERS FOR WARHEADS AND WARHEADS HAVING IMPROVED LINERS

(75) Inventor: Sami Daoud, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 93 days.

(21) Appl. No.: 13/009,075

(22) Filed: Jan. 19, 2011

(65) Prior Publication Data

US 2012/0247358 A1 Oct. 4, 2012

(51) Int. Cl.
*F42B 1/028* (2006.01)
*F42B 1/032* (2006.01)

(52) U.S. Cl.
USPC ..... 102/476; 102/306

(58) Field of Classification Search
USPC ..... 102/475, 476, 307, 308, 309, 310, 305, 102/306
See application file for complete search history.

(56) References Cited

U.S. PATENT DOCUMENTS

| | | | | | |
|---|---|---|---|---|---|
| 4,441,428 | A | * | 4/1984 | Wilson | 102/307 |
| 4,498,367 | A | * | 2/1985 | Skolnick et al. | 86/1.1 |
| 4,649,828 | A | | 3/1987 | Henderson et al. | |
| 4,766,813 | A | * | 8/1988 | Winter et al. | 102/307 |
| 4,860,654 | A | * | 8/1989 | Chawla et al. | 102/306 |
| 4,942,819 | A | * | 7/1990 | Thoma et al. | 102/476 |
| 5,070,786 | A | | 12/1991 | Hartman et al. | |
| 5,155,296 | A | | 10/1992 | Michaluk | |
| 5,191,169 | A | | 3/1993 | Hu | |
| 5,259,317 | A | * | 11/1993 | Lips | 102/307 |
| 5,365,852 | A | | 11/1994 | Bender et al. | |
| 5,540,156 | A | | 7/1996 | Fong | |
| 5,847,312 | A | * | 12/1998 | Walters et al. | 102/309 |
| 5,859,383 | A | | 1/1999 | Davison et al. | |
| 5,925,845 | A | | 7/1999 | Tompkins et al. | |
| 6,021,714 | A | * | 2/2000 | Grove et al. | 102/307 |
| 6,152,040 | A | | 11/2000 | Riley et al. | |
| 6,308,634 | B1 | | 10/2001 | Fong | |
| 6,363,828 | B1 | | 4/2002 | Sherlock et al. | |
| 6,393,991 | B1 | | 5/2002 | Funston et al. | |
| 6,510,797 | B1 | | 1/2003 | Fong | |
| 6,564,718 | B2 | * | 5/2003 | Reese et al. | 102/307 |
| 6,868,791 | B1 | | 3/2005 | Thompson et al. | |
| 6,899,032 | B2 | | 5/2005 | Ronn et al. | |
| 7,150,235 | B1 | | 12/2006 | Mikhail | |
| 7,278,354 | B1 | | 10/2007 | Langan et al. | |
| 7,360,488 | B2 | | 4/2008 | Stawovy | |
| 7,621,221 | B2 | | 11/2009 | Ritman | |
| 2005/0241522 | A1 | * | 11/2005 | Stawovy | 102/476 |
| 2009/0078144 | A1 | * | 3/2009 | Behrmann et al. | 102/307 |
| 2010/0096136 | A1 | * | 4/2010 | Bourne et al. | 166/299 |
| 2011/0239888 | A1 | * | 10/2011 | Waddell et al. | 102/307 |

* cited by examiner

*Primary Examiner* — Bret Hayes
(74) *Attorney, Agent, or Firm* — Thorpe North & Western LLP

(57) ABSTRACT

Improved liners and explosive devices having improved liners are provided. In accordance with an exemplary embodiment, a liner for an explosive device comprises a plate configured to be positioned against an explosive charge. The plate comprises rhenium, palladium, or a combination thereof, at least a bimodal particle size distribution having a powder grain size no greater than 25 microns, a substantially circular diameter, and a substantially concave interior relative to a surface of the explosive charge.

12 Claims, 3 Drawing Sheets

LINERS FOR WARHEADS AND WARHEADS HAVING IMPROVED LINERS

FIELD OF THE INVENTION

The present invention generally relates to explosive devices, and more particularly relates to improved liners for warheads and warheads having improved liners.

BACKGROUND OF THE INVENTION

Explosively-formed penetrator (EFP) warheads have proven useful against steel and other re-enforced armors. In a conventional single EFP, illustrated in FIG. 1, a main explosive charge 12 proximate to a detonator ignition train 18 is pressed or cast and machined in a steel casing or shell 14 that accommodates a liner 16 having a hemispherical, trumpet, conical or other similar shape. When the liner 16 has a trumpet or conical shape, the warhead is referred to as a shape charge (SC) rather than an EFP and is characteristically used for perforations and demolitions because its stand-off distance is shorter than the stand-off distance of an EFP warhead. Typically, the liner is made of a highly ductile metal having a high density, such as copper, molybdenum, tungsten, aluminum, or the like. As illustrated in FIG. 2, when the EFP 12 main explosive charge 12 is detonated by the detonator ignition train 18, the liner 16 is projected forward as a molten-metal elongated slug, referred to as a penetrating jet, which can travel typically at speeds above 9.66 kilometers per second (6 miles per second). The high velocity, high density jet is able to pierce metal armors and other similar re-enforcements.

The concept of using explosive energy to deform a metal plate into a coherent penetrator while simultaneously accelerating it to extremely high velocities offers a unique method of employing a kinetic energy liner without the use of a gun barrel. However, such armor perforation capability needs further improvement to counter new generations of harder armored targets, without resorting to a larger caliber weapon system. In addition, while present day liners may be able to penetrate targets such as tanks and underground bunkers, there is a need for warheads that deliver high velocity penetrating jets with enhanced explosive output.

Accordingly, it is desirable to provide liners of EFP and SC warheads with improved kinetic energy. It is also desirable to provide liners for EFP and SC warheads that provide enhanced explosive output. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Improved liners and explosive devices having improved liners are provided. In accordance with an exemplary embodiment, a liner for an explosive device comprises a first plate configured to be positioned against an explosive charge. The first plate comprises rhenium, palladium, or a combination thereof, at least a bimodal particle size distribution having a powder grain size no greater than 25 microns, a substantially circular diameter, and a substantially concave interior relative to a surface of the explosive charge.

In accordance with a further exemplary embodiment, a liner for an explosive device having an explosive charge is provided. The liner comprises a first plate, a second plate coupled to the first plate and an explosive interposed between the first plate and the second plate.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The various embodiments contemplated herein relate to improved liners and explosive devices with improved liners. In one embodiment, the various embodiments relate to ultra-high kinetic energy liners formed, at least in part, of rhenium (Re), palladium (Pd), or a combination thereof. The kinetic energy of a liner is proportional to its density and velocity. Theoretically then, the greater the density of the material from which the liner is made, the greater the kinetic energy of the liner. In turn, the greater the kinetic energy of the liner, the greater the penetration depth of the liner. However, other factors play a part in the fabrication of a liner. For example, the liner also should be formed of a highly ductile material with a high melting point that is easy to process. Rhenium and palladium meet these criteria. In addition, to prevent collapse of the liner during manufacture, upon explosive initiation, and during travel through the atmosphere, the liner material comprises at least bimodal particle size distribution with a grain size no greater than 25 microns. In other embodiments contemplated herein, various embodiments relate to composite liners and explosive devices with composite liners. The composite liners comprise two plates coupled together with an explosive material interposed between them. Upon detonation of the warhead, the liner forms a penetrating jet that pierces and explodes at its target.

Figure 1:
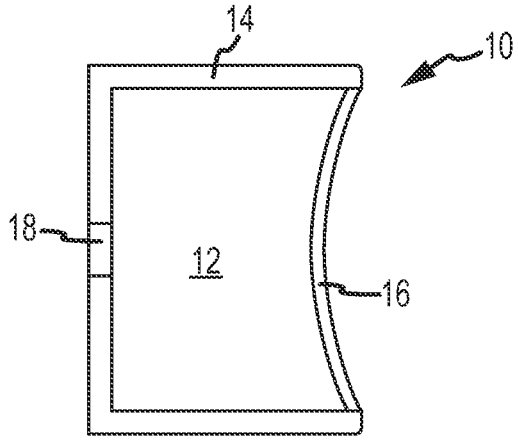
FIG.1 (PRIOR ART)
FIG. 1 is a cross-sectional view of a conventional explosively-formed penetrator (EFP)
Figure 2:
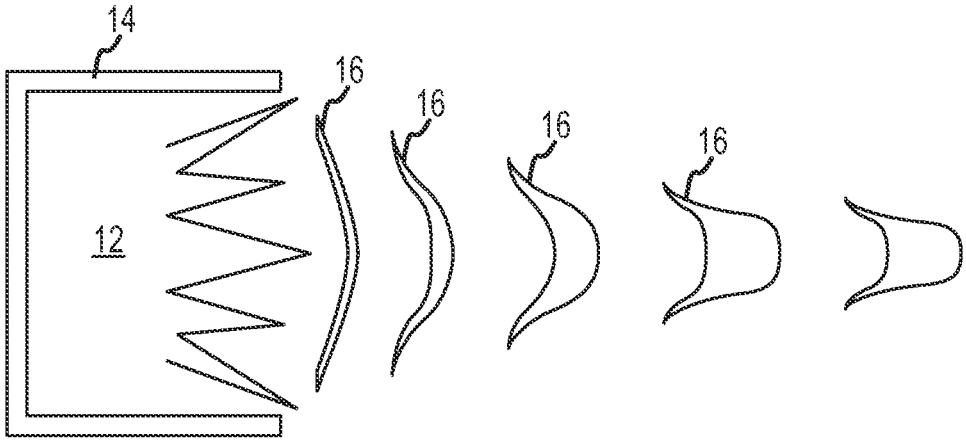
FIG.2 (PRIOR ART)
FIG. 2 is a cross-sectional view of the EFP of FIG. 1 during phases of detonation, formation of a slug, and travel of the slug in a unidirectional path.
Figure 3:
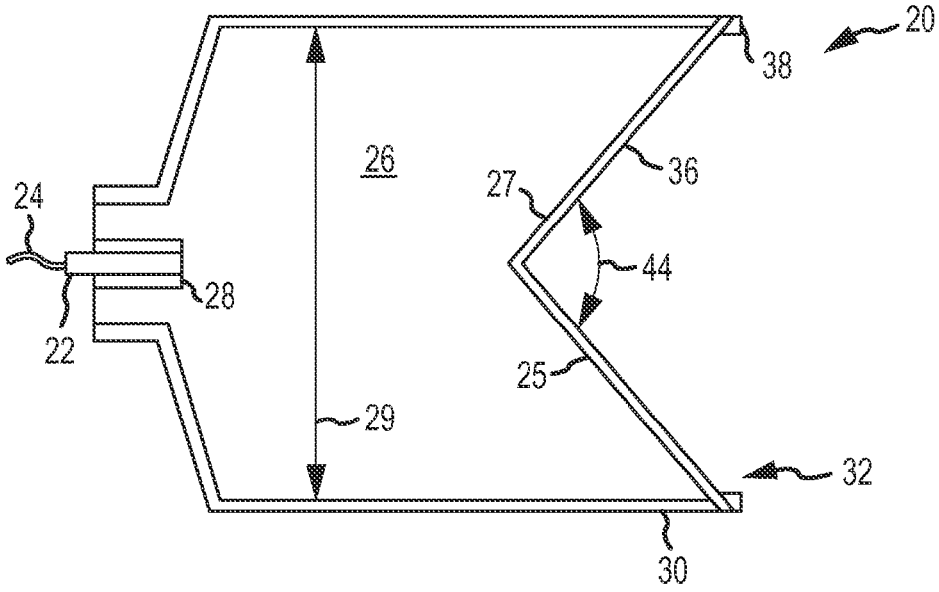
FIG. 3 is a cross-sectional view of a shaped charge (SC) warhead in accordance with an exemplary embodiment.
Figure 4:
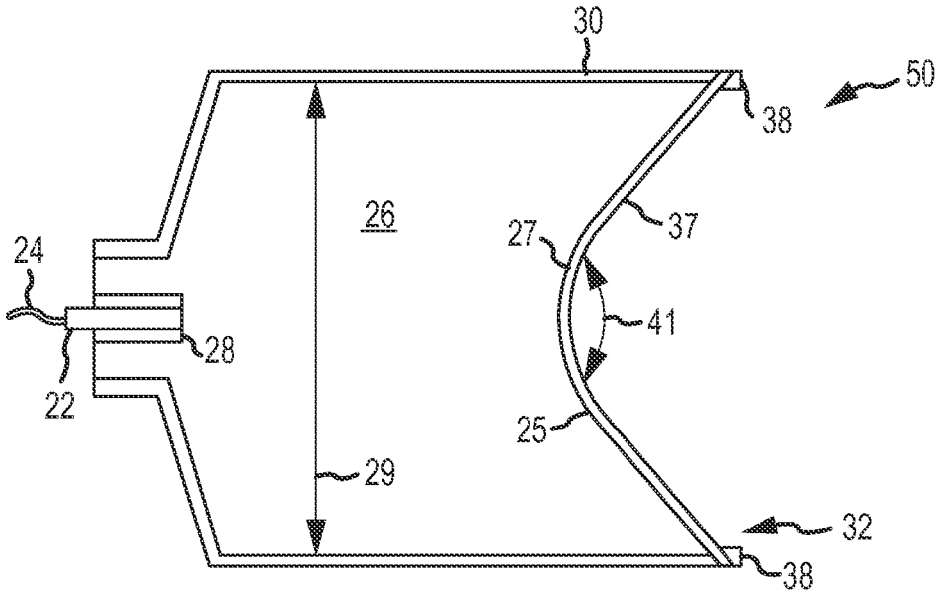
FIG. 4 is a cross-sectional view of an EFP warhead in accordance with an exemplary embodiment.

FIG. 3 illustrates a cross-sectional view of a shaped charge (SC) warhead 20 and FIG. 4 illustrates a cross-sectional view of an explosively-formed penetrator (EFP) warhead 50 (collectively, "the warheads") in accordance with exemplary embodiments. The warheads each comprise an ignition train of at least one initiator 22. The initiator 22 may comprise azide-based explosives, such as lead azide, and lead styphnate, lead picrate, mercury fulminate, zirconium potassium perchlorate (ZPP) and derivatives thereof, thermite, combinations thereof, and the like. In a preferred embodiment, the initiator comprises an insensitive munition-type (IM) explosive material of cis-bis-(5-nitrotetrazolato) tetramine cobalt (III) perchlorate (hereinafter "BNCP"), also referred to as Bis, nitro-cobalt-III-perchlorate, particles, and desensitized BNCP, essentially BNCP that is encapsulated by a surfactant. An IM explosive material is one with properties that render it capable of withstanding sympathetic detonation as a result of mechanical shocks, fire, electrostatic discharge, or impact by shrapnel, yet is still capable of high-order detonation per design intent. Explosive materials comprising surfactant-encapsulated BNCP particles and methods for manufacturing the explosive materials are disclosed in U.S. patent application Ser. No. 12/636,935 filed Dec. 14, 2009 by the same inventors of the inventions disclosed herein.

A fuze component system 24 is physically and/or electrically coupled to the initiator 22 and comprises a fuze to ignite the initiator upon receiving a signal. The signal can be transmitted to the fuze component system via radio or electromagnetic waves from a transmitter located remote from the warheads and can be received by a receiver within the warhead within or outside of the fuse component system. The fuze component system may include a sensor (not shown) such as, for example, a height-of-burst sensor, an acceleration-deceleration sensor, an impact sensor, a pressure sensor, a time delay sensor, a heat sensor, an optical sensor, a microelectromechanical (MEMs) sensor, or a combination thereof, that can activate the fuze component system 24 to ignite the fuze. The sensor can be configured to provide the signal to the fuze component system 24 based upon acceleration, height, barometric pressure, electronic, or dynamic movement of the warhead, a predetermined time or time period, distance from a target or a combination thereof. For example, the sensor may be able to sense the distance the warhead is from the ground or from an object/target on the ground, water, or in the air and, thus, transmit a signal to the fuze component system 24 that activates the initiator 22 so that the warhead detonates at predetermined distances from enemy tanks, vehicles, missile launchers, mine fields, etc., on the ground, bunkers, enemy aircrafts, helicopters, etc., in the air, and/or submarines, boats, aircraft carriers, underwater mine fields, etc., in the water.

In an optional embodiment, a secondary explosive, or booster, charge 28 may encase the initiator 22 by being cast about the initiator 22 and, in turn, is encased by a main explosive charge 26 having IM properties. The booster charge may comprise materials such as PBXN-5, PBXN-7, PBXN-9, CH-6, and the like. The warhead 20, 50 is detonated when the initiator 22 is ignited by the fuze component system 24, generating a shock wave in the booster charge 28 that detonates the main explosive charge 26. In other embodiments, such as when the initiator 22 is sufficiently brisant, a booster charge 28 may not be necessary and the initiator 22 may be used to detonate the main explosive charge 26.

In one exemplary embodiment, the main explosive charge 26 is a plastic-bonded explosive, also called a PBX or a polymer-bonded explosive. A PBX generally contains an energetic fuel or "oxidizer" homogeneously dispersed in a matrix of a synthetic thermoset or thermoplastic polymer commonly referred to as a "binder matrix". In this form, the PBX is a high output explosive and may be formulated to exhibit IM properties. Conventional PBXs typically comprise oxidizers such as HMX (or "high melting point explosive"), chemically known as cyclotetramethylene tetranitramine, RDX (or "royal demolition explosive"), chemically known as cyclotrimethylene trinitramine, Cl-20, chemically known as 2,4,6,8,10,12-hexanitro-2,4,6,8,10,12-hexaazaisowurtzitane, TATB, chemically known as triaminotrinitrobenzene (also using IUPAC designation, 3,5-triamino-2,4,6-trinitrobenze), FOX-7, also known as 1,1-diamino-2,2-dinitroethene (DADNE), or combinations thereof. In a preferred embodiment, the main explosive charge 26 is a PBX composition having an oxidizer comprising octanitrocubane (ONC) homogeneously and intimately dispersed within a binder matrix. ONC has the empirical formula $C_8N_8O_{16}$.

The ONC is mixed and distributed homogenously throughout the binder matrix of the PBX composition and can be present in the PBX composition in one or various particle sizes. For example, in one embodiment, ONC is present is bimodal, having, for example, a blend of coarse ONC particles with a particle size distribution of about 150 to about 400 micrometers (μm) and fine particles with a particle size distribution of about 15 to about 45 μm. In a second embodiment, the ONC is bimodal, having a blend of coarse and fine particles in the ratio of about 5:2, respectively. In a third embodiment, the ONC is trimodal, having, for example, a blend of coarse ONC particles with a particle size distribution of about 150 to about 400 μm, fine particles with a particle size distribution of about 15 to about 45 μm, and ultrafine particles with a particle size distribution of about 1 to about 15 μm. In a fourth embodiment, the ONC is trimodal, having a blend of coarse, fine, and ultrafine particles in the ratio of about 5:3:2, respectively. Of course, the ONC particles may be present in any other sizes and size distributions suitable for a particular explosives application.

Depending on a desired explosives application, in addition to ONC, the oxidizer of the PBX composition may also comprise other oxidizers, such as TATB, DADNE, HMX, RDX, Cl-20, or combinations thereof. For example, in various explosives applications, it may be desirable to combine oxidizers that impart different characteristics, namely, ballistics properties coupled with mechanical properties, mechanical properties coupled with ease of processing properties, or consolidation characteristics coupled with particle size and hardness properties, etc. Alternatively, in other various explosives applications, it may be desirable to minimize cost of the PBX composition by using an oxidizing component that can be purchased at a lower price than ONC. Most desirably, a PBX composition that imparts the highest IM properties and the highest explosive output is used. Thus, a preferred embodiment comprises ONC, TATB, DADNE, HMX, Cl-20, or combinations thereof. In one embodiment, the oxidizer may comprise from about 5 to about 95 wt. % ONC and from about 95 to about 5 wt. % HMX. In a second embodiment, the oxidizer may comprise from about 5 to about 95 wt. % ONC and from about 95 to about 5 wt. % Cl-20. In a third embodiment, the oxidizer may comprise from about 5 to about 95 wt. % ONC and from about 95 to about 5 wt. % RDX. In a fourth embodiment, the oxidizer may comprise from about 5 to about 95 wt. % ONC and from about 95 to about 5 wt. % aluminum. In a fifth embodiment, the oxidizer may comprise from about 5 to about 95 wt. % ONC and from about 95 go about 5 wt. % TATB. In a sixth embodiment, the oxidizer may comprise from about 5 to about 95 wt. % ONC and from about 95 to about 5 wt. % DADNE. In a seventh embodiment, the oxidizer may comprise from about 5 to about 5 wt. % ONC and from about 95 to about 5 wt. % of any combination of TATB, DADNE, HMX, RDX, Cl-20, aluminum, and/or other oxidizers.

The various embodiments of the PBX composition also contain a binder matrix comprised of a thermoset synthetic resin or a high-temperature, high-performance thermoplastic synthetic elastomer. The binder matrix, in addition to allowing the PBX composition to be manipulated during fabrication into various shapes and forms, also serves as a desensitizer and a fuel for the detonation of the PBX composition.

The binder matrix is the backbone component used in the PBX composition, as it provides the skeletal structure for the explosive charge upon which the remaining constituents reside. The binder matrix can comprise energetic or inert synthetic resins. Examples of inert synthetic resins suitable for use in various embodiments of the PBX composition include, but are not limited to, polysulfone (PS), polyether sulfone (PES), polyphenyl sulfone (PPS), polyphenylene sulfide, Viton® fluoroelastomer available from DuPont Performance Polymers of Wilmington, Del., PTFE and other fluoropolymers, polyaryl ketones, such as polyetherether ketone (PEEK), polyetherketone (PEK), and polyetherketoneketone (PEKK), polyisobutylene (PIB), hydroxyl-terminated polybutadiene (HTPB), carboxyl-terminated polybutadiene (CTPB), polybutadiene-acrylic acid-acrylonitrile (PBAN), polyurethanes, polyesters, polyimides, cellulose acetate (CA), cellulose acetate butyrate (CAB), ethylene vinyl acetate (EVA), and combinations thereof. Examples of energetic synthetic resins suitable for use in various embodiments of the PBX composition include, but are not limited to, glacidyl azide polymer (GAP), nitropolyurethanes, nitrocellulose, polyvinyl nitrate, and combinations thereof. In one preferred embodiment, the synthetic resin comprises polyisobutylene (PIB). In another preferred embodiment, the PBX composition comprises a synthetic resin in an amount of from about 2 to about 20 wt. % of the PBX composition. ONC-comprising PBX materials and methods for manufacturing the compositions are disclosed in U.S. patent application Ser. No. 12/579,202 filed Oct. 14, 2009 by the same inventors of the liners contemplated herein.

A cylindrical case or housing 30 comprising a rigid, hollow cylinder contains the main explosive charge 26 and the ignition train comprising the fuze component system 24, the initiator 22, and, if present, the booster charge 28. The housing may be fabricated from a metal, such as steel or aluminum, or any other suitable structural composite, such as a carbon fiber composite. The housing comprises a spherical opening 32.

The warheads 20, 50 each further comprise a liner 36, 37 respectively. Each liner is positioned within the spherical opening 32 of the housing 30 and is embedded, pressed or otherwise positioned against a concave, recessed cavity or dimple 25 of the surface 27 of the main explosive charge 26. A retaining ring or similar retainer 38 may be used to retain the liner within the housing 30. In one exemplary embodiment, as in the case of the shaped-charge (SC) warhead 20, the liner has a trumpet geometry or, as illustrated in FIG. 3, a conical geometry, having an apex angle designated by double-headed arrow 44. The apex angle may be in the range of about 15 to about 125 degrees. As in the case of the EFP warhead 50, the liner has an arc-shaped geometry, as illustrated in FIG. 4, with an apex angle designated by double-headed arrow 41. The apex angle 41 can range from about 130 to about 175 degrees. The liner can range in diameter depending on armor penetration depth requirements but the diameter is preferably equal to the charge diameter. The liner thickness may be in the range of about 3% to about 5% of the main explosive charge diameter, indicated by double-headed arrow 29. In a preferred embodiment, the liner thickness is about 3% +/−0.2% of the main explosive charge diameter.

The liner 36, 37 is fabricated from rhenium (Re), palladium (Pd), or a combination thereof. The penetration of the liner through re-enforced military armor is proportional to the density of the material from which the liner is made. Both rhenium and palladium have a density higher than copper, which is typically used to make liners. The solid density of rhenium is 21.02 grams/cubic centimeter (g/cc) and the solid density of palladium is 12.02 g/cc, while the solid density of copper is only 8.94 g/cc. The rhenium material from which the liner is made is preferably 99% pure rhenium, more preferably 99.9% pure rhenium, and most preferably 99.99% pure rhenium. Similarly, the palladium material from which the liner is made is preferably 99% pure palladium, more preferably 99.9% pure palladium, and most preferably 99.99% pure palladium. The liner can be 100 weight percent (wt. %) rhenium, 100 wt. % palladium, or can be a combination of rhenium and palladium. In one embodiment, the palladium and rhenium are present in a ratio of about 3 to about 97 wt. % palladium: about 97 to about 3 wt. % rhenium. In a preferred embodiment, the palladium and rhenium are present in a ratio of about 12 to about 15 wt. % palladium: about 88 to about 85 wt.% rhenium. The liner can also include other materials in addition to rhenium and/or palladium such as, for example, copper, tantalum, and steel. For example, because the Vickers Hardness of rhenium is 40% lower than tungsten, it may be advantageous in certain applications to add tungsten to the liner material to enhance the liner hardness. The liner can be fabricated using any known technique such as, for example, cold-working, annealing, chemical vapor deposition, and the like.

In another embodiment, the liner 36, 37 is formed of material having a powder grain size no greater than 25 microns (μm). In a preferred embodiment, the grain size is no greater than 1000 nanometers (nm) and in a more preferred embodiment, the grain size is no greater than 100 nm. Using rhenium and/or palladium materials with such grain size minimizes the fabrication of porous liners. Porosity degrades the mechanical characteristics of liners. Liners with an unacceptable amount of porosity tend to collapse during manufacture and also during explosive detonation and travel through the atmosphere. Further to this end, in an embodiment, the particle size distribution of the liner material is bimodal. In a preferred embodiment, the particle size distribution of the liner material is trimodal, and in a more preferred embodiment, the particle size distribution of the liner material is multimodal. Materials with at least bimodal particle size distributions also exhibit lower porosity than unimodal particle size distribution materials. In one embodiment, about 25% of the particles have a grain size in the range of about 100 to about 300 nm and about 75% of the particles have a grain size in the range of about 20 to about 75 nm.

Figure 5:
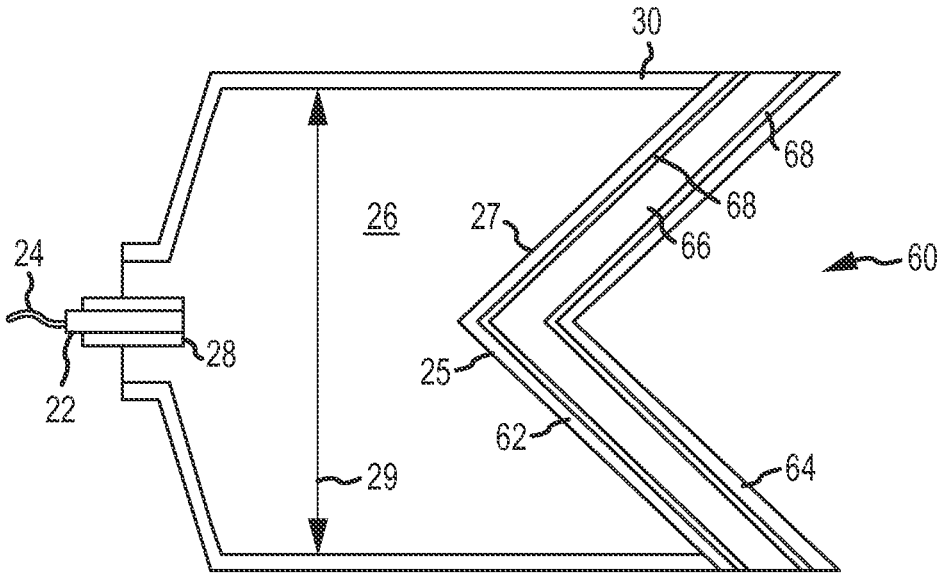
FIG. 5 is a cross-sectional view of an SC warhead with a composite liner in accordance with an exemplary embodiment.
Figure 6:
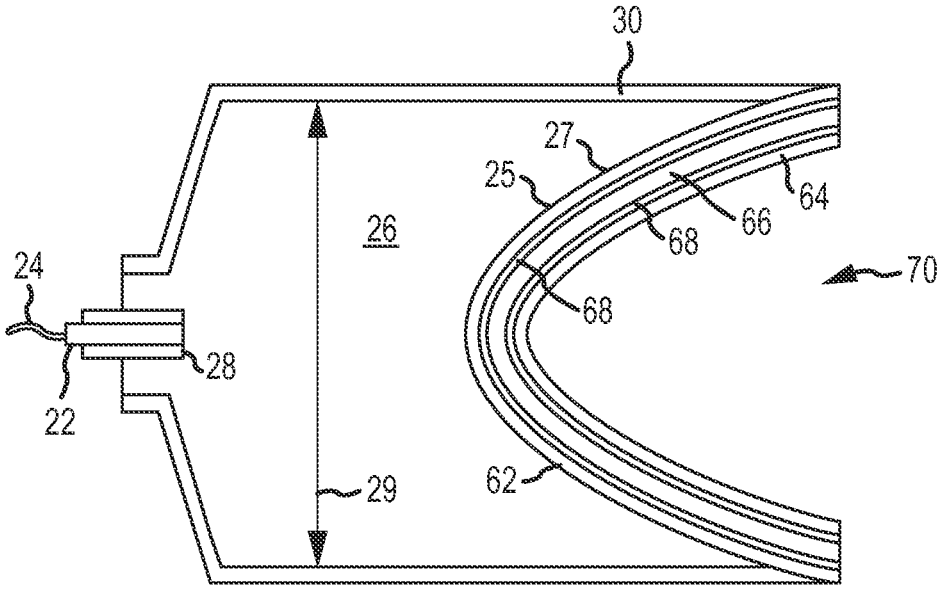
FIG. 6 is a cross-sectional view of an EFP warhead with a composite liner in accordance with an exemplary embodiment.

In another embodiment, the warheads 20, 50 of FIGS. 3 and 4 may alternatively comprise composite liners 60 and 70, cross-sectional sections of which are illustrated in FIGS. 5 and 6, respectively. Composite liner 60 has a shape-charge (SC) geometry and composite liner 70 has an explosively-formed penetrator (EFP) geometry. Both liners have a sandwich configuration with a first plate 62 that, like liners 36 and 37 of FIGS. 3 and 4, is disposed in cavity 25 against surface 27 of main explosive charge 26. First plate 62 can be fabricated from any of the materials from which liners 36 and 37 described above are fabricated or can be fabricated from any other materials from which conventional liners are made. A second plate 64 is coupled to the first plate 62 and has the same geometry as first plate 62. In a preferred embodiment, the second plate 64 is formed of the same material and composition as first plate 62, although the material of second plate may have a composition different from the first plate 62 to achieve a functional application. The first plate 62 and second plate 64 can be coupled by any suitable method, such as by electronic bonding, laser bonding, gluing, riveting, and the like.

A liner explosive 66 is interposed between the first plate 62 and the second plate 64. The liner explosive can be formed of any of the materials described above with reference to main explosive charge 26. In one embodiment, a thermal shield 68, such as, for example, Kaowool® Flex-Wrap available from Thermal Ceramics, Inc. of Augusta Georgia, is interposed between the liner explosive 66 and the first plate 62 and/or between the liner explosive 66 and the second plate 64. The thermal shield is a thermal insulator/heat sink that prevents thermal degradation of the explosion of the main explosive charge 26 from detonating the liner explosive 66 prematurely. The thicknesses of the first plate, the second plate, the thermal shields 68, and the liner explosive are such that the thickness of the total composite liner 60, 70 is about 7 to about 25% of the main explosive charge diameter 29, preferably about 20% +/−2% of the main explosive charge diameter.

Due to their configuration, the composite liners 60 and 70 act as piercing mini-warheads. Detonation of the initiator 22 by the fuze component system 24 generates a shock wave in the booster charge 28 that travels through the main explosive charge 26. Upon the violent initiation of the main explosive charge 26, the composite liner 60, 70 is expelled forward. The liner collapses upon itself and inverts, transforming into a carrot-shaped penetrator jet of a molten metal slug. The penetrator jet travels at hypervelocity speed, for example, at speeds of 9 to 10 kilometers per second. The kinetic energy of the penetrator/slug is a product of the mass of the material that forms the penetrator/slug and the velocity of the penetrator/slug. Such shaped devices are effective penetrators of targets formed from single or multiple layers of materials such as rolled steel, ceramic, or composite armors. Because the main explosive charge projects the liner, at hypervelocity, the hypervelocity penetrator/slug can pierce armors of land, air, or sea vehicles. Once the target is pierced, the liner explosive 66 of the composite liner 60, 70 explodes, causing further destruction within the target.

Accordingly, improved liners for warheads have been described. In particular, ultra-high kinetic energy warhead liners comprising rhenium, palladium, or a combination thereof that counter new generations of harder armored targets have been described. In addition, composite explosive liners also have been described. The composite liners deliver high velocity penetrating jets with enhanced explosive output.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liner for a warhead, the liner comprising:

a first plate configured to be positioned against an explosive charge of the warhead, a second plate coupled to the first plate, and an explosive disposed between the first plate and the second plate, the first plate comprising:

rhenium, palladium, or a combination thereof;

the first plate being formed of material having at least a bimodal particle size distribution and having a powder grain size no greater than 25 microns;

a substantially circular diameter; and a substantially concave interior relative to a surface of the explosive charge the second plate comprising rhenium, palladium, or a combination thereof.

2. The liner of claim 1, wherein the first plate has a thickness in the range of about 3% to about 5% of a diameter of the explosive charge.

3. The liner of claim 1, wherein the first plate comprise at least 99% pure rhenium.

4. The liner of claim 1, wherein the first plate comprises at least 99% pure palladium.

5. The liner of claim 1, wherein the first plate comprises a combination of palladium and rhenium in a ratio of about 3 to about 97 wt.% palladium: about 97 to about 3 wt.% rhenium.

6. The liner of claim 1, wherein the first plate further comprises a metal selected from the group consisting of copper, tantalum, steel, and tungsten.

7. The liner of claim 1, wherein the first plate comprises a multimodal particle size distribution.

8. The liner of claim 1, wherein about 25% of particles of the first plate have a grain size in the range of about 100 to about 300 nm and about 75% of particles of the first plate have a grain size in the range of about 20 to about 75 nm.

9. The liner of claim 1, wherein the liner has a thickness is in the range of about 7 to about 25% of a diameter of the explosive charge.

10. The liner of claim 1, further comprising a thermal shield interposed between the first plate and the explosive.

11. A liner for a warhead, the liner comprising a first plate configured to be positioned against an explosive charge of the warhead, the first plate comprising:

a combination of palladium and rhenium in a ratio of about 3 to about 97 wt.% palladium: about 97 to about 3 wt.% rhenium;

the first plate being formed of material having at least a bimodal particle size distribution and having a powder grain size no greater than 25 microns;

a substantially circular diameter; and a substantially concave interior relative to a surface of the explosive charge.

12. A liner for a warhead, the liner comprising a first plate configured to be positioned against an explosive charge of the warhead, the first plate comprising:

rhenium, palladium, or a combination thereof;

the first plate being formed of material having at least a bimodal particle size distribution and having a powder grain size no greater than 25 microns, about 25% of particles of the first plate having a grain size in the range of about 100 to about 300 nm and about 75% of particles of the first plate having a grain size in the range of about 20 to about 75 nm;

a substantially circular diameter; and a substantially concave interior relative to a surface of the explosive charge.

* * * * *